US005198407A

United States Patent [19]

Motegi et al.

[11] Patent Number: 5,198,407

[45] Date of Patent: Mar. 30, 1993

[54] HEAT-SENSITIVE STENCIL SHEET

[75] Inventors: Katsumi Motegi; Motoshi Okugawa; Kouji Masuda, all of Shizuoka, Japan

[73] Assignee: Tomoegawa Paper Co., Ltd., Tokyo, Japan

[21] Appl. No.: 531,647

[22] Filed: Jun. 1, 1990

[30] Foreign Application Priority Data

Jun. 2, 1989 [JP] Japan ..... 1-139027

[51] Int. Cl.[5] ..... B41M 5/30; B41M 5/40

[52] U.S. Cl. ..... 503/226; 427/153; 503/200

[58] Field of Search ..... 428/137, 195, 913; 503/200, 226; 427/152

[56] References Cited

U.S. PATENT DOCUMENTS

| | | | |
|---|---|---|---|
| 3,149,564 | 9/1964 | Wartman et al. | 101/125 |
| 3,715,263 | 2/1973 | Kubo et al. | 428/29 |

FOREIGN PATENT DOCUMENTS

| | | | |
|---|---|---|---|
| 1961974 | 6/1970 | Fed. Rep. of Germany . | |
| 2051988 | 6/1971 | Fed. Rep. of Germany . | |
| 2050024 | 1/1972 | Fed. Rep. of Germany . | |
| 2048845 | 3/1971 | France . | |
| 60-19591 | 1/1985 | Japan . | |
| 1328408 | 8/1973 | United Kingdom | 503/200 |

*Primary Examiner*—Pamela R. Schwartz

*Attorney, Agent, or Firm*—Cushman, Darby & Cushman

[57] ABSTRACT

A heat-sensitive stencil sheet is disclosed, which comprises a porous sheet having on one side thereof at least an adhesive layer and a thermoplastic resin film layer in this order, wherein at least one of the layers constituting said stencil sheet contains a heat-sensitive color-forming material. The layer containing the heat-sensitive color-forming material develops a color on thermal perforation to visualize the perforated image so that a printing ink, particularly plural inks of different color, can be easily applied to the stencil sheet in proper positions in proper quantities.

4 Claims, 1 Drawing Sheet

HEAT-SENSITIVE STENCIL SHEET

FIELD OF THE INVENTION

This invention relates to a heat-sensitive stencil sheet for use in mimeographic printing. More particularly, it relates to a heat-sensitive stencil sheet which is directly printable with a thermal head of a printing machine, e.g., a word processor, and when mounted on printing equipment of handy scale, typically a printer for private use (e.g., "Print Gokko®" manufactured by Riso Kagaku Corporation, hereinafter referred to as a handy printer), provides several hundreds 100 printed copies. The heat-sensitive stencil sheet of the invention has excellent workability in application of a printing ink, particularly in multi-color printing by using a single original plate.

BACKGROUND OF THE INVENTION

Printing on post cards, greeting cards, etc. amounting to several hundreds 100 sheets has recently been conducted by a handy printer using an orginal plate prepared from a heat-sensitive stencil sheet comprising a porous sheet and a thermoplastic resin film (hereinafter referred to as mimeographic printing). Original plates which can be used in this printing system have conventionally been prepared by a process in which a heat-sensitive stencil sheet is superposed on an original prepared by printing a layout by a word processor or by reproducing a layout by plain paper copying (PPC), and the stencil sheet is then exposed to a flash by means of a flash bulb, etc. Alternatively, a layout may be directly printed on each card by means of a word processor. However, any of these techniques is not only troublesome and time-consuming but incurs cost.

In the light of these circumstances, the inventors previously proposed an original plate which can be perforated directly by means of plate making using a thermal head, such as a word processor. The original plate used in this system comprises an ordinary stencil sheet on one side of which reinforcing paper is adhered, and the area of the reinforcing paper corresponding to a printed image is cut out. Therefore, image perforation using a thermal head is easy, and mimeographic printing can easily be carried out simply by cutting off the part corresponding to a printed image.

However, since the stencil sheet itself has a conventional construction, it was difficult to clearly distinguish a perforated area using a thermal head from a non-perforated area. Therefore, workability in ink application on the perforated area before conducting handy printing was poor, particularly in multi-color printing in which two or more kinds of inks different in color are applied to different areas of a single original plate.

In more detail, in the stencil sheet having been partly perforated by thermal printing with a thermal head to form an image, the perforated area and the non-perforated area cannot be clearly distinguished with eyes due to a small contrast therebetween. On the other hand, where multi-color printing is conducted using a single original plate, inks having different colors should be separately supplied to the original plate in different places of the perforated image before mimeographic printing. As set forth above, since the perforated part of the conventional heat-sensitive stencil sheet is not clearly distinguishable, it has been difficult to apply each of inks having different colors on a single original plate according to different colors of a desired image with good workability and high efficiency.

SUMMARY OF THE INVENTION

As a result of extensive investigations, it has now been found that a perforated image of a heat-sensitive stencil sheet can be visualized through thermal color formation upon thermal perforation, thereby to make the perforated area clearly distinguishable from the non-printed area, by incorporating a heat-sensitive color-forming material into at least one of layers constituting the stencil sheet, including a porous sheet, an adhesive layer, a thermoplastic resin film layer, and other optional layers.

That is, the present invention relates to a heat-sensitive stencil sheet which comprises a porous sheet having on one side thereof at least an adhesive layer and a thermoplastic resin film layer in this order, wherein at least one of the layers constituting the stencil sheet contains a heat-sensitive colorforming material.

As a matter of course, where an anti-tack layer is separately provided, the heat-sensitive color-forming material may be incorporated in this layer. It is also possible to provide an independent heat-sensitive color-forming layer contiguously to the above-described layers.

DETAILED DESCRIPTION OF THE INVENTION

Figure 1:
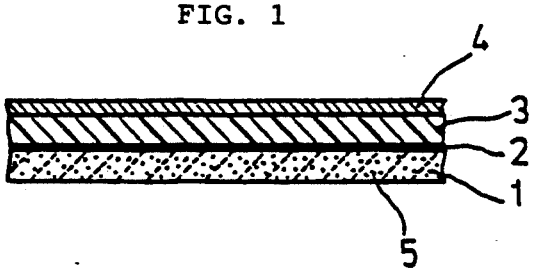
FIG. 1 is a cross-sectional view of an example of the heat-sensitive stencil sheet according to the present invention.

The heat-sensitive stencil sheet according to the present invention comprises a porous sheet having on one side thereof at least an adhesive layer and a thermoplastic resin film layer in this order, with a heat-sensitive color-forming material being present in at least one of the layers constituting the stencil sheet.

Where the thermoplastic resin film layer is comprised of a material having release properties by itself, such as a fluorine resin and a silicone resin, an anti-tack layer is not necessary. Otherwise, an anti-tack layer is provided on the surface of the thermoplastic resin film layer.

The heat-sensitive color-forming material which can be used in the present invention may be any of conventionally known materials. Preferred among them is a two-component system comprising a color former and a color developer.

The color former and color developer which are basic materials of the heat-sensitive color-forming material may be incorporated either into the same layer or separately into two or more layers. For example, in the case where a color former is added to an anti-tack layer, while adding a color developer to an adhesive layer, a thermoplastic resin film layer sandwiched therebetween is melted on thermal perforation whereby the color former and color developer are also melted and undergo color formation reaction to develop a color.

It is a matter of course that a layer containing the heat-sensitive color-forming material may be independently provided in contact with at least one of the above-described layers.

Examples of suitable heat-sensitive color-forming material systems are described below for illustrative purposes only but not for limitation.

(1) Dye Color Formation System:

Color formation reaction between a colorless dye, i.e., a color former (electron donor) and an acidic substance, i.e., a color developer (electron acceptor) is utilized. Specific examples of materials subject to color formation reaction are as follows.

(A) Color Formers:

Color formers are substantially colorless per se but develop deep colors on contact with an electron acceptor, e.g., bisphenol A. Examples include:

(a) Leuco-Triphenylmethane Compounds:
- 3,3-Bis(p-dimethylaminophenyl)phthalide
- 3,3-Bis(p-dimethylaminophenyl)-6-dimethylaminophthalide (CVL)
- 3,3-Bis(p-dimethylaminophenyl)-6-diethylaminophthalide 4-Hydroxy-4'-dimethylaminotriphenylmethane lactone 4,4,-Bis-dihydroxy-3,3,-bisdiaminotriphenylmethane lactone (b) Leuco-Fluoran Compounds:
- 3-Dimethylamino-6-methoxyfluoran
- 3,6-Bis-β-methoxyethoxyfluoran
- 3-Diethylamino-6-methyl-7-chlorofluoran
- 3,7-Bisdiethylaminofluoran
- 3- Diethylamino-7-methoxyfluoran (c) Leuco-Spiropyran Compounds:
- 3-Phenyl-8'-methoxybenzoindolinospiropyran
- 8'-Methoxybenzoindolinospiropyran
- 4,7,8,'-Trimethoxybenzoindolinospiropyran (d) Leuco-Auramine Compounds:
- 4,4'-Bisdimethylamino-3,4-chlorophenyl leucoauramine
- 4,4'-Bisdimethylaminopiperazinehydrol (e) Leuco-Phenothiazine Compounds:
- p-Methoxybenzoyl Leucomethylene Blue These color formers provide a variety of hue, such as blue, black, red, green, and orange, depending on the kind thereof.

(B) Color Developers:

Electron acceptors as color developers include acid clays, e.g., terra alba, kaolin, and zeolite, organic acids, e.g., oxalic acid, maleic acid, citric acid, stearic acid, benzoic acid, and gallic acid, and phenolic compounds. Examples of the phenolic compounds are catechol, resorcin, hydroquinone, naphthol, β-naphthol, 3,5-xylenol, thymol, pyrogallol, phloroglucin, phloroglucinolcarboxylic acid, 4-t-butylphenol, 4-phenylphenol, 4-hydroxydiphenoxide, 4-hydroxyacetophenone, methyl-4-hydroxybenzoate, 4-t-octylcatechol, 4,4'-secbutylidenediphenol, 2,2'-dihydroxydiphenol, 4,4'-isopropylidenediphenol (bisphenol A), 2,2'-methylenebis(4-methyl-6-t-butylphenol), 4,4'-cyclohexylidenephenol, and 4,4'-isopropylidenebis(2-chlorophenol). In addition, phenolformaldehyde resin, novolak phenol resin, and halogenated novolak phenol resin are also useful.

(2) Metallic Compound Color Formation System:

Examples of a combination of an electron-accepting component and an electron-donating component include a combination of a long-chain fatty acid iron salt (e.g., ferric stearate, ferric myristate) and a phenolic compound (e.g., tannic acid, gallic acid, ammonium salicylate), a combination of an organic acid heavy metal salt (e.g., Ni, Co, Pb, Cu, Fe, Ag, Hg, or Ag salt of acetic acid, stearic acid, or palmitic acid) and an alkaline earth metal sulfide (e.g., CaS, SrS, BaS) or- an organic chelating agent (e.g., s-diphenylcarbazide, diphenylcarbazone) a combination of an oxalic acid heavy metal salt (e.g., Ag, Pb, Hg, or Th salt) and a sulfur compound (e.g., Na-tetrathionate, sodium thiosulfate, thiourea), a combination of an organic acid noble metal salt (e.g., silver oxalate, mercury oxalate) and an organic polyhydroxyl compound (e.g., polyhydroxyl alcohols, glycerin, glycol), a combination of an organic acid noble metal salt (e.g., silver behenate, silver stearate) and an aromatic organic reducing agent (e.g., protocatechuic acid, spiroindane, hydroquinone), and a combination of a fatty acid ferric salt (ferric stearate) and an aromatic polyhydroxyl compound (e.g., 3,4-dihydroxytetraphenylmethane).

These systems develop such colors as black, bluish black, deep blue, dark red, red, and purple. In general, a combination of gallic acid or tannic acid with ferric stearate is used to develop a black color. To enhance black color development, some reagents for organic spot testing may be used in combination.

(3) Dyestuff Formation System:

A dyestuff intermediate is reacted by heating to form a dyestuff. For example, resorcin and a nitroso compound are combined to form an oxazine dye, or a carbinol base of a triphenylmethane dye is combined with chloroacetanilide as an acid color former to form a dyestuff.

The heat-sensitive color-forming material may further contain various conventional additives in addition to the above-described essential components.

The porous sheet which can be used in the stencil sheet of the present invention typically includes paper, nonwoven fabric or woven fabric, which is made mainly of natural fibers, e.g., "mitsumata" (Edqeworthia papvrifera), paper mulberry (Broussonetia kazinoki Sieb.), and Manila hemp, or synthetic fibers, e.g., rayon, polyvinyl alcohol, and polyester. However, it should be understood that the porous sheet is not deemed to be limited thereto.

Materials of the adhesive layer are selected appropriately from, for example, polyester resins, polyvinyl acetate resins, polyvinyl chloride resins, and polyacrylate resins.

Examples of suitable resins of the thermoplastic resin film layer include polyvinyl chloride, polyvinylidene chloride, polyvinyl acetate, polyvinyl acetal, polystyrene, polycarbonate, polyester, polyamide, cellulose acetate, ethyl cellulose, acrylic resins, fluorine resins, silicone resins, etc.; copolymers comprising monomer units constituting these homopolymers; and polymer blends thereof. However, it should be understood that the thermoplastic resin film is not deemed to be limited thereto.

In carrying out thermal perforation on the stencil sheet with a word processor, it is preferable that a reinforcing sheet from which the area corresponding to a printed image can be cut out after the thermal perforation is fixed to the surface of the porous sheet, and an ink-impermeable sheet is overlaid on the reinforcing sheet with at least one side of the peripheral portion of the reinforcing sheet being adhered thereto. The reinforcing sheet which can be used is a flexible reinforcing sheet, such as paper, synthetic resin films, and synthetic resin foamed sheets, having a stiffness of from 3 to 150 gf.cm as determined according to stiffness test of board under flexural load as specified in JIS P 8125. The reinforcing sheet facilitates perforation operation with a word processor.

The ink-impermeable sheet which can be used includes synthetic resin sheets having no compatibility with printing inks, such as sheets of polyester, fluorine resins, silicone resins, and vinylidene chloride resins, paper, coated paper, metallic foils, and woven fabric.

Embodiments of the present invention are illustrated below by referring to the drawings. As shown in FIG. 1, the heatsensitive stencil sheet of the present invention comprises a porous sheet 1 having formed on one side thereof an adhesive layer 2, a thermoplastic resin film layer 3 and, if desired, an anti-stack layer 4 in this order.

At least one of these layers contains a heat-sensitive color-forming material 5. In this particularly embodiment, the heat-sensitive color-forming material 5 has been incorporated into the porous sheet 1.

Figure 2:
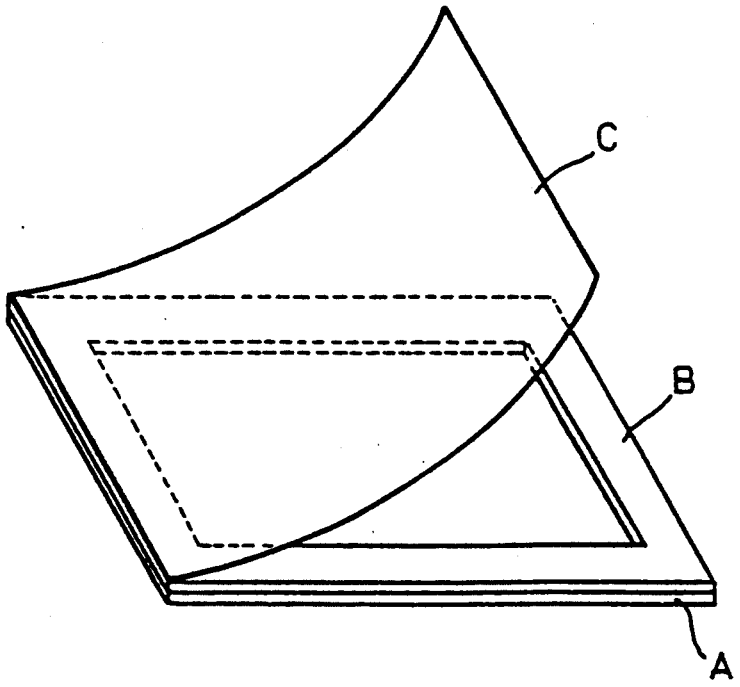
FIG. 2 is a perspective view of an example of a heat-sensitive original plate for mimeographic printing in which the stencil sheet of FIG. 1 is used.

FIG. 2 illustrates a structure of an original plate constructed by using the stencil sheet of the present invention, in which a heat-sensitive stencil sheet A cut to a prescribed size has adhered thereon a frame B (the abovedescribed reinforcing sheet from which an area corresponding to a thermally printed area has been cut out), and an inkimpermeable sheet C is superposed and partly adhered thereon.

The present invention is now illustrated in greater detail with reference to Examples, but it should be understood that the present invention is not deemed to be limited thereto. All the parts, percents, and ratios are given by weight unless otherwise specified.

EXAMPLE 1 a) Preparation of Heat-Sensitive Color-Forming Coating Composition

| | |
|---|---|
| Solution A: | |
| 3-Diethylamino-6-methyl-7-anilinofluoran | 30 parts |
| 10% Polyvinyl alcohol aqueous solution | 30 parts |
| Water | 40 parts |
| Solution B: | |
| 2,2-Bis(4-hydroxyphenyl)propane | 20 parts |
| Calcium carbonate | 20 parts |
| 10% Polyvinyl alcohol aqueous solution | 30 parts |
| Water | 50 parts |

Each of Solutions A and B was separately dispersed in a ball mill for 24 hours. Eight parts of Solution A, 30 parts of Solution B, 6 parts of stearamide (2% solution), 20 parts of a 10% polyvinyl: alcohol aqueous solution, and 36 parts of water were mixed to prepare a heat-sensitive color-forming coating composition.

b) Preparation of Heat-Sensitive Stencil Sheet

A 1.5 μm thick polyester film ("Emblet ®" produced by Unitika Ltd.) as a thermoplastic resin film layer was coated with a saturated polyester resin ("Vylon ®"200" produced by Toyobo Co., Ltd., isocyanate (hardener)) as an adhesive to a coating amount of 1.0 g/m$^2$ with a wire bar to form an adhesive layer. Manila hemp paper (basis weight: 11 g/m$^2$; thickness: 40 μm) as a porous sheet was then adhered on the adhesive layer by wet laminating.

A cold-setting silicone resin comprising a base ("Torray ® Silicone PRX 305" produced by Toray Silicone Co., Ltd.) and a Co hardener ("Tora ® Silicone SH 23K" produced by Toray Silicone Co., Ltd.) was then coated on the polyester film to a coating amount of 0.1 g/m$^2$, followed by drying to form an anti-tack layer.

The above-prepared heat-sensitive color-forming coating composition was impregnated into the porous sheet to a pickup of 5 g/m$^2$, followed by drying. There was thus obtained a heat-sensitive stencil sheet having the heat-sensitive color-forming material impregnated into the porous sheet thereof.

c) Preparation of Heat-Sensitive Original Plate for Use in Mimeoqraphic Printing:

Board having a thickness of 180 μm and a stiffness of 23 gf.cm was fixed to the surface of the porous sheet of the heat-sensitive stencil sheet as a reinforcing sheet. Further, an ink-impermeable sheet was overlaid on the board with one end thereof being adhered to the corresponding end of the board to prepare a heat-sensitive original plate for mimeographic printing.

An original was perforated on the resulting original plate with a word processor, and the area of the reinforcing sheet corresponding to the printed area of the stencil sheet was cut out to form a frame as shown in FIG. 2.

Inks of different colors were applied between the porous sheet and the ink-impermeable sheet. The original plate was mounted on a handy printer ("Print Gokko ®" produced by Riso Kagaku Corporation), and mimeographic printing was conducted to obtain 100 copies. All the copies obtained had a multi-color clear image with high fidelity to the original and with neither color shear nor color mixing.

In the above operation, the heat-sensitive color-forming material-impregnated layer developed a color on perforation with a word processor in areas surrounding the perforated image to visualize the image, so that the inks could be applied in proper quantities neither too much nor too less.

EXAMPLE 2

Preparation of Heat-Sensitive Color-Forming Coating Composition for Adhesive Layer:

| | |
|---|---|
| Solution C: | |
| Diphenylcarbazone | 30 parts |
| Vinyl chloride-vinyl acetate copolymer resin (solids content: 40%) | 250 parts |
| Ethanol | 2700 parts |
| Solution D: | |
| Ferric stearate | 150 parts |
| Stearic acid | 20 parts |
| Ethanol | 300 parts |

Solution D having been dispersed in a ball mill for 24 hours and Solution C having been thoroughly dissolved were mixed by stirring to prepare a heat-sensitive color-forming coating composition (Coating Composition E) for an adhesive layer.

A heat-sensitive stencil sheet was prepared in the same manner as in Example 1, except for using Coating Composition E as a coating composition for an adhesive layer and not impregnating the heat-sensitive color-forming materials into the porous layer, and an original plate was prepared in the same manner as in Example 1 by using the resulting stencil sheet.

When perforation on the original plate was carried out in the same manner as in Example 1, the adhesive layer developed a color in the areas surrounding the perforated image to visualize the image. On mimeographic printing in the same manner as in Example 1, 100 copies having a clear image free from shear could be printed off.

EXAMPLE 3

| Coating Composition F for Adhesive Layer: | |
|---|---|
| Polyester resin ("Vylon 200") | 2 parts |
| 2,2-Bis(4-hydroxyphenyl)propane | 3 parts |
| Methyl ethyl ketone | 60 parts |
| Toluene | 35 parts |
| **Coating Composition G for Anti-tack Layer:** | |
| Silicone resin ("Toray ® Silicone PRX 350" as a base; "Toray ® Silicone SH 23K" as a hardener) | 2.5 parts |
| 3-Methylcyclohexylamino-6-methyl-7-anilinofluoran | 2.5 parts |
| Methyl ethyl ketone | 95.0 parts |

A heat-sensitive stencil sheet was prepared in the same manner as in Example 2, except for using Coating Composition F in an amount of 2.0 g/m$^2$ and Coating Composition G in an amount of 0.3 g/m$^2$ to form an adhesive layer and an anti-tack layer, respectively.

The resulting stencil sheet was evaluated in the same manner as in Example 1. On thermal perforation, the adhesive layer and the anti-tack layer developed a color in the areas surrounding the perforated image to visualize the image. On mimeographic printing, 100 copies having a clear image free from shear could be printed off.

As described above, since at least one of layers constituting a heat-sensitive stencil sheet of the present invention contains a heat-sensitive color-forming material, when the stencil sheet is directly perforated with a thermal head of a word processor, etc., the thermally perforated area thereof develops a color to visualize the image. Hence, a printing ink can be applied in a proper position in a proper quantity according to the image. When, in particular, multicolor printing is carried out using a single original plate, inks of multiple colors can be easily arranged to give clear copies free from color shear.

While the invention has been described in detail and with reference to specific embodiments thereof, it will be apparent to one skilled in the art that various changes and modifications can be made therein without departing from the spirit and scope thereof.

What is claimed is:

1. A heat-sensitive stencil sheet comprising:

a porous sheet having on one side thereof at least an adhesive layer;

a thermoplastic resin film layer fixed on said adhesive layer; and a heat-sensitive color-forming material contained within at least one of layers constituting said stencil sheet, said heat-sensitive color-forming material comprising a combination of a color former and a color developer, said color former being selected from the group consisting of leuco compounds.

2. A heat-sensitive stencil sheet as claimed in claim 1 wherein said stencil sheet further comprises an anti-leak layer on the thermoplastic resin film layer.

3. A heat-sensitive stencil sheet as claimed in claim 1, said color former being selected from the group consisting of leuco-triphenylmethane compounds, leuco-fluoran compounds, eluco-spiropyran compounds, leuco-auramine compounds and leuco-phenothiazine compounds.

4. A heat-sensitive stencil sheet as claimed in claim 1, said color developer being selected from the group consisting of phenolic compounds.

* * * * *